US007455029B2

(12) United States Patent
Janesky

(10) Patent No.: US 7,455,029 B2
(45) Date of Patent: Nov. 25, 2008

(54) CONDENSATION-COLLECTING ELEMENT AND METHOD

(75) Inventor: Lawrence Janesky, Seymour, CT (US)

(73) Assignee: Basement Systems, Inc., Seymour, CT (US)

( * ) Notice: Subject to any disclaimer, the term of this patent is extended or adjusted under 35 U.S.C. 154(b) by 342 days.

(21) Appl. No.: 10/756,604

(22) Filed: Jan. 13, 2004

(65) Prior Publication Data

US 2005/0150277 A1 Jul. 14, 2005

(51) Int. Cl.
*G01D 13/00* (2006.01)

(52) U.S. Cl. ..... 116/200; 116/227

(58) Field of Classification Search ..... 116/200–201, 116/1, 109, 216, 220, 227, DIG. 7, 206; 73/863.11, 73/863.12, 29.04, 73; 340/604
See application file for complete search history.

(56) References Cited

U.S. PATENT DOCUMENTS

| | | | | | |
|---|---|---|---|---|---|
| 1,364,035 | A | * | 12/1920 | Carter, Jr. | 436/177 |
| 2,139,114 | A | * | 12/1938 | Demers | 137/205 |
| 3,085,424 | A | * | 4/1963 | Berg | 73/29.02 |
| 3,117,442 | A | * | 1/1964 | Brooks | 73/73 |
| 3,393,983 | A | * | 7/1968 | Washington | 48/2 |
| 3,788,128 | A | * | 1/1974 | Strohecker | 73/73 |
| 4,020,478 | A | * | 4/1977 | Hatfield | 340/604 |
| 4,264,902 | A | * | 4/1981 | Miller | 340/604 |
| 4,390,291 | A | * | 6/1983 | Gaven et al. | 374/160 |
| 4,417,267 | A | * | 11/1983 | Wada et al. | 257/721 |
| 4,607,501 | A | * | 8/1986 | Vanlier | 62/288 |
| 4,944,253 | A | * | 7/1990 | Bellofatto | 122/14.21 |
| 5,211,679 | A | * | 5/1993 | Meyer | 73/863.12 |
| 5,339,676 | A | * | 8/1994 | Johnson | 73/40 |
| 6,175,310 | B1 | * | 1/2001 | Gott | 340/605 |
| 6,208,262 | B1 | * | 3/2001 | Jones | 340/693.5 |
| 6,663,679 | B1 | * | 12/2003 | Duncan | 73/335.01 |
| 6,698,378 | B1 | * | 3/2004 | Dick et al. | 116/206 |
| 6,873,263 | B1 | * | 3/2005 | Hohman | 340/602 |
| 6,981,337 | B2 | * | 1/2006 | Jones et al. | 34/80 |
| 7,105,225 | B2 | * | 9/2006 | Birkholz et al. | 428/354 |
| 7,213,534 | B2 | * | 5/2007 | Siikaluoma et al. | 116/206 |
| 2003/0230152 | A1 | * | 12/2003 | McGill et al. | 73/864.34 |

FOREIGN PATENT DOCUMENTS

| | | | |
|---|---|---|---|
| JP | 01250742 | A * | 10/1989 |
| WO | WO 8704911 | A * | 8/1987 |

* cited by examiner

*Primary Examiner*—R. A. Smith
*Assistant Examiner*—Amy Cohen Johnson
(74) *Attorney, Agent, or Firm*—Perman & Green, LLP

(57) ABSTRACT

A novel method and means for indicating whether the source of water accumulation on a concrete floor of a basement or other subterranean room is moisture condensation, even some time after the moisture content or humidity of the atmosphere within the room has been reduced.

The novel means comprises a temperature-conductive, rust-resistant metallic plate for condensing and collecting water from a humid basement atmosphere when the temperature of the plate is lower than the dewpoint of the humid atmosphere. The metallic plate has a thickness of at lest about 0.2 inch and has a flat bottom surface for temperature conductive contact with a flat concrete basement floor. The plate also has an upper surface having with a centralized recessed area for the accumulation of water condensed from the humid atmosphere in the basement when the temperature of the metallic plate, as conducted from the basement floor, is lower than the dewpoint of the humid atmosphere surrounding the metallic plate.

17 Claims, 1 Drawing Sheet

CONDENSATION-COLLECTING ELEMENT AND METHOD

BACKGROUND OF THE INVENTION

1. Field of the Invention

The present invention relates to an improved method for detecting whether the accumulation of water on basement floors is due to water vapor condensation from warmer humid air touching cool concrete floor temperatures, or due to other causes. Concrete floors particularly concrete floors installed or poured over the dirt surfaces of sub-terrainean rooms such as basement living spaces of homes or the ground-level rooms or workspaces of slab-homes or buildings are particularly susceptible to water vapor condensation and/or penetration. Conventionally, such concrete floors are covered with plastic tiles or carpeting to improve their appearance and make them more comfortable to the feel.

However, concrete floors are dense and conduct the cold temperature of the ground, which can result in water vapor condensation at the interior surface of the concrete floor, causing separation of floor tiles adhered thereto or causing a moisture accumulation in carpeting adhered thereto or applied thereover, resulting in mold or mildew. Water vapor and water can penetrate and diffuse through the porous concrete floor from the dampness of the soil or ground beneath the concrete, and also through cracks which can develop in the concrete. Also, water can penetrate through interfaces between the floor and the walls and/or footings.

2. State of the Art

Generally the accumulation of water on basement floors is due to the penetration of external groundwater, under hydrostatic pressure, through the wall/footing interface around the periphery of the concrete floor. External ground water accumulates around the outer periphery of the subterranean wall footing and seeps through the wall/footing interface in substantial volumes over a period of time.

It is known to install very effective water control systems for admitting such groundwater into such basement rooms and channeling the admitted water into a dry well or into a sump container from which it is pumped to an external location, and reference is made to my U.S. Pat. No. 5,367,842 for its disclosure of such a system.

Also, to a lesser extent the accumulation of water on basement floors may be due to water vapor penetration from the ground up through a concrete basement floor and condensation of such water vapor onto cold surfaces present within the basement, such as onto the cold surface of the concrete floor or onto cold water pipes.

Therefore it is not always apparent what the source of water accumulation on a concrete basement floor might be, whether an installed water control system may be leaking, or water vapor may be diffusing up through the concrete floor, or condensation may be occurring.

Condensation can result in offensive odors in a basement. The moisture can damage carpeting, boxes, and property in a basement. Each year in the hot summer months, millions of basements experience dampness, musty odors, even puddles from condensation of water vapor from moist air onto cool surfaces in a cool basement. Often times this moisture is confused for groundwater seepage.

Condensation worsens as the outside air gets hotter and more humid. For example, on a day when the outside temperature is 85 degrees, and the relative humidity of the air is 80%, the dewpoint is 78 degrees. This means that any surface having a temperature that is less than 78 degrees will "sweat", which means that the moisture from the air will condense on it. As moist warm air enters a cool basement, with cool surface temperatures of around 65 degrees, it is cooled and gives up its moisture onto the cool surfaces. Porous surfaces such as concrete, carpeting and wood will soak up the moisture and appear damp—which is why condensation fools so many people into believing it's due to the leakage of exterior groundwater into the basement.

SUMMARY OF THE INVENTION

The present invention relates to a novel means for indicating whether the source of water accumulation on a concrete floor of a basement or other subterranean room is moisture condensation, even some time after the moisture content or humidity of the atmosphere within the room may have been reduced.

The present invention provides a novel, inexpensive, temperature-conductive, flat metallic condensation plate or disc having an upper surface which has a concave or dished area or a recessed area forming a well for the accumulation or collection of water from any water vapor condensed from humid air in contact therewith due to the condensation plate being cold from contact with a cold concrete floor.

According to a preferred embodiment of the present invention the water-accumulation well of the present condensation plate is provided with a water-sensitive indicator means, such as a water-reactive tape strip, which permanently changes color upon contact with water, and retains the color change even after the water is removed or evaporated.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT(s)

Figure 1:
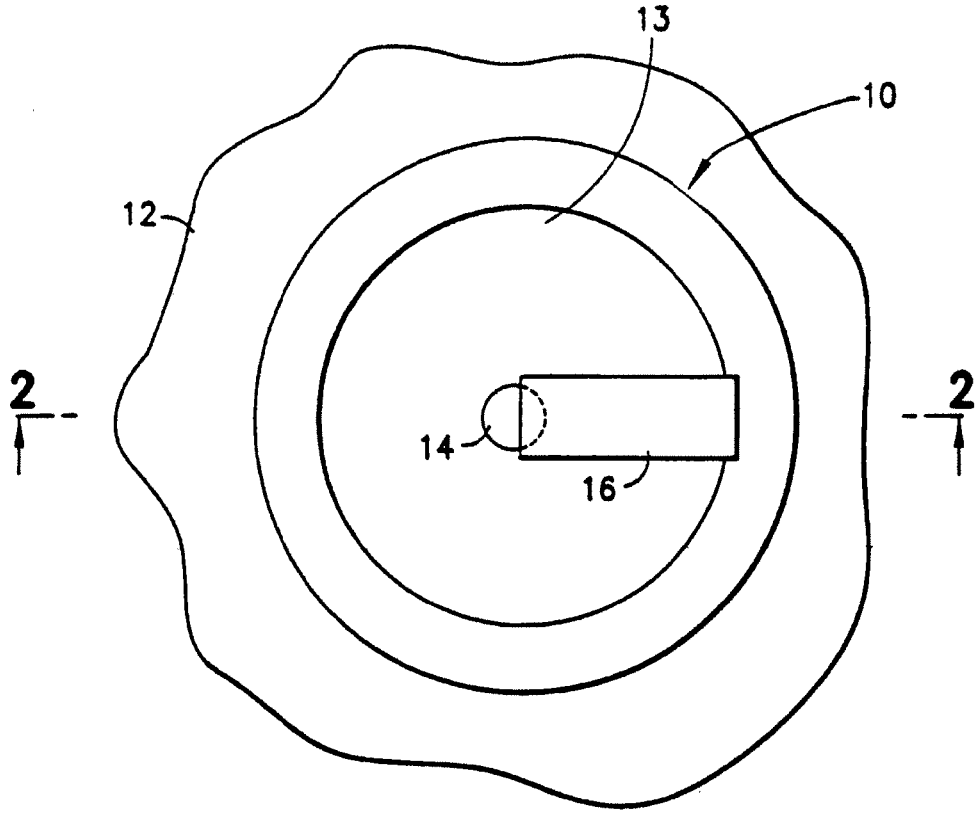
FIG. 1 is a top view of a metallic water-condensation disc, to scale, according to a preferred embodiment of the present invention, having a visual indicator tape strip attached to the recessed well area.
Figure 2:
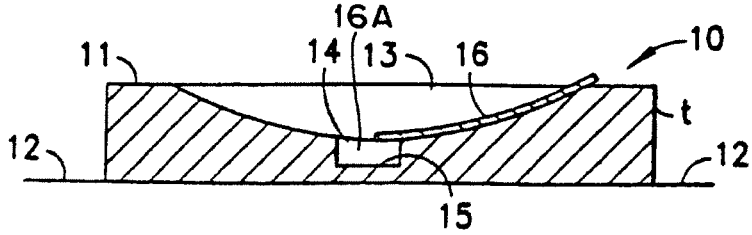
FIG. 2 is a diagrammatic cross-section view of the disc shown in FIG. 1, taken along the line 2-2.

Referring to the drawings, the present water-condensation disc 10 is formed from a dense metal, preferably a lightweight, rust-resistant metal such as aluminum, stainless steel, or steel painted or coated to render it rust-resistant, having a thickness (t) greater than 0.2 inch, preferably 0.5 inch up to about 6 inches, and a diameter preferably between about 2½ and 5 inches, such as about 3 inches. The thickness "t" is important to space the upper surface 11 of the disc 10 from the concrete floor 12 on which, it is supported, by a sufficient distance to prevent any water present on the floor from flowing onto the upper surface 11 of the disc 10 and into the recessed well area 13 which is intended to receive and accumulate only water condensed out of the basement atmosphere onto the cold metal disc 10. The recessed well area 13 of the drawings is concave and has a central well 14. The well area 13 preferably extends to a depth of more than ½ the thickness of the disc 10, and the central well 14 extends down to a floor 15 having a thickness less than one-fourth the thickness of the plate 10. The floor 15 of the well 14 is closely spaced from the concrete floor 12 and therefore the temperature of the floor is quickly conducted to the entire disc 10 and particularly to the floor 15 of the well 14.

The present rust-resistant metallic plate preferably consists of a lightweight rust-resistant aluminum alloy, but other metals may also be used, such as stainless steel or other ferrous metals which are coated with rust-resistant coatings.

The basement floor is always cool because the earth is always cool, about 55° F. year round. When warm moist air contacts cold surfaces, water vapor from the air condenses out of the atmosphere onto cold surfaces such as the basement floor and the surface 11 of the present condensation disc 10. The condensed droplets can be easily observed on the upper surface of the disc, showing that the problem is caused by water vapor condensation from the air. Further, in extreme cases, the condensed water flows down into the well area 13 and the central well 14 and accumulates as a puddle therein to prove that the water problem is due to moisture condensation rather than exterior water leaking into the basement room through basement wall cracks or wall/footing interfaces.

While the water accumulated in the recessed well area 13 is retained therein for a long period of time, as visible indication 16A or proof that the water problem in the basement is the result of water-vapor condensation, the preferred embodiment of the present invention provides a water-reactive indicator tape 16 in contact with the surface of the concave well area 13 and the central well 14, to provide a permanent color-change indication that water had condensed into those areas of the disc 10 even after the water evaporates. Many chemicals and dyes are known in the art which are water-soluble and which are colorless or obscured in solid form and which have and/or which react to develop an intense color when dissolved in water alone or in combination with other agents. The test strip 16 is impregnated with one or more of said chemicals so that it develops an intense permanent color, such as red or blue or green, when wetted with water.

The developed color remains even after the condensation problem disappears.

Since the weather changes outside, the conditions for condensation to occur vary. For example, if the weather turns less humid or cooler, or both, for a few days, the condensation problem may begin to go away or subside. On a day that is 75 degrees and 50% relative humidity outside, the dewpoint is 55 degrees. The surfaces in a basement are warmer than 55°, so condensation will not continue to form, and the dampness that is there will begin to dry up. Then the next day it could be hot and humid again, and the condensation resumes. The water collection well area 13 and central well 14 of the present condensation disc 10 particularly in association with the color-forming test strip 16, provides clear and lasting evidence of the existence of a water-condensation problem rather than a water-seepage problem so that the property-owner can take appropriate action.

In order to solve a condensation problem one must close the windows and doors to the outside to stop the outside air from coming in. Since one can never completely eliminate air exchange with the outside, one must dehumidify the basement air, such as by using a household dehumidifier. However, unless the basement is very small, with frequent emptying of the dehumidifier (which can be three times a day), a household dehumidifier may not be adequate.

The Basement Systems, Inc. SaniDry™ Basement Air System is a very powerful and effective dehumidification unit which will rapidly dry out the basement air to under 50% relative humidity—a level that will stop condensation.

The air in turn will dry out the building materials and make the odor in the basement go away.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

The invention claimed is:

1. A basement floor water source detector for detecting and identifying a source of basement floor water, the basement floor water source detector comprising:

a temperature-conductive, rust-resistant metallic plate for condensing and collecting water from a humid atmosphere when the temperature of the plate is lower than a dewpoint of the humid atmosphere, said metallic plate having a flat bottom surface for temperature-conductive contact with a flat concrete basement floor and having an upper surface provided with a centralized recessed area and another portion for the accumulation of water; and an indicator, coupled to the recessed area, the indicator being arranged so that the accumulation of water from the other portion of the metallic plate causes the indicator to indicate the source of basement floor water being condensate from the humid atmosphere and not from water present on the basement floor from another source.

2. The detector according to claim 1, wherein the metallic plate is formed from dense aluminum alloy and is shaped to define the indicator.

3. The detector according to claim 1, wherein the metallic plate is in the form of a circular disc having a thickness of about 0.5 inch.

4. The detector according to claim 1 in which the other portion of said upper surface is a concave area.

5. The detector according to claim 4 in which said concave area communicates with the central recessed area into which condensed water drains from the surface of said concave area.

6. The detector according to claim 5 in which the concave area tapers down to a thickness of about one-half the thickness of the metallic plate, and the central recessed area extends down therefrom to a floor having a thickness of less than one-quarter of the thickness of the metallic plate.

7. The detector according to claim 1 in which the centralized recessed area communicates with the indicator, wherein the indicator comprises a water-sensitive indicator material which changes color upon contact with water.

8. The detector according to claim 7 in which the water-sensitive indicator material is present in the form of a length of tape adhered to the upper surface of the plate.

9. The basement floor water source detector of claim 1, wherein the indicator is a first indicator of basement floor water source, and wherein the centralized recessed area defines a second indicator of basement floor water source, the second indicator being different from the first indicator, and wherein the second indicator is arranged so that the accumulation of water provides a second indication different from the first indicator that the source of basement water is condensate from the humid atmosphere and not from water present on the basement floor from another source.

10. A method for identifying the source of water accumulation on a concrete basement floor from a number of different sources, which comprises contacting the basement floor with the flat bottom surface of a temperature-conductive rust-resistant metallic plate which is arranged to define a basement floor water source detector which condenses and collects water from a humid atmosphere when the temperature of the plate is lower than the dewpoint of the humid basement atmosphere, said metallic plate having a flat bottom surface in temperature-conductive contact with the concrete basement floor, and having an upper surface provided with a centralized recessed area and another portion for the accumulation of water; and providing an indicator, coupled to the recessed area, and arranging the indicator so that the accumulation of water from the other portion of the metallic plate causes the indicator to indicate the source of the water accumulation on the basement floor being condensate from the humid atmosphere and not from water present on the basement floor from another source.

11. The method according to claim 10 in which the metallic plate is formed from dense aluminum alloy.

12. The method according to claim 10 in which the metallic plate is in the form of a circular disc having a thickness of about 0.5 inch.

13. The method according to claim 10 in which the other portion of the upper surface of the metallic plate is a concave area.

14. The method according to claim 13 in which the concave area communicates with the central recessed area into which condensed water drains from the surface of said concave area.

15. The method according to claim 14 in which the concave area tapers down to a thickness of about one-half the thickness of the metallic plate, and the central recessed area extends down therefrom to a floor having a thickness of less than one-quarter of the thickness of the metallic plate.

16. The method according to claim 10 which further comprises contacting the centralized recessed areas of the plate with the indicator, wherein the indicator comprises a water-sensitive indicator material which changes color upon contact with water.

17. The method according to claim 16 in which the water sensitive indicator material is applied to the recessed area of the plate in the form of a length of tape which is adhered to the upper surface of the plate.

* * * * *